US007393233B2

(12) United States Patent
Machida et al.

(10) Patent No.: US 7,393,233 B2
(45) Date of Patent: Jul. 1, 2008

(54) ELECTRICAL CONNECTOR HAVING LOCKING MECHANISM FOR LOCKING CONNECTOR HOUSINGS

(75) Inventors: Yukifumi Machida, Tokyo (JP); Shinji Yamaguchi, Tokyo (JP); Yoshikazu Tanaka, Tokyo (JP); Makoto Enari, Tokyo (JP); Tetsu Hirose, Tokyo (JP)

(73) Assignees: FCI, Versailles (FR); Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 10/541,519

(22) PCT Filed: Sep. 4, 2003

(86) PCT No.: PCT/JP03/11305

§ 371 (c)(1),
(2), (4) Date: Feb. 22, 2006

(87) PCT Pub. No.: WO2004/064200

PCT Pub. Date: Jul. 29, 2004

(65) Prior Publication Data

US 2006/0160433 A1 Jul. 20, 2006

(30) Foreign Application Priority Data

Jan. 10, 2003 (JP) ..... 2003-003995

(51) Int. Cl.
*H01R 13/627* (2006.01)

(52) U.S. Cl. ..... 439/353; 439/752

(58) Field of Classification Search ..... 439/353, 439/357, 752, 358
See application file for complete search history.

(56) References Cited

U.S. PATENT DOCUMENTS 5,584,719 A 12/1996 Tsuji et al. ..... 439/354

FOREIGN PATENT DOCUMENTS

| | | |
|---|---|---|
| EP | 0189979 A1 | 8/1986 |
| EP | 0519815 A | 12/1992 |
| JP | 2849897 | 6/1995 |
| JP | 2002-075523 | 3/2002 |
| JP | 2002-334739 | 11/2002 |
| JP | 2003-257533 | 9/2003 |

*Primary Examiner*—Javaid Nasri
(74) *Attorney, Agent, or Firm*—Harrington & Smith, PC

(57) ABSTRACT

In an electrical connector assembly, housings are locked with each other by locking a rear holder provided in a first connector with a cooperating second connector. In a rear holder main body 52 of a rear holder 51 there are formed a plurality of resilient clamping lances 53 which clamp connection terminals 67 inserted into respective terminal receiving holes 62 formed in a housing main body 61. At a middle upper portion of the rear holder 51 there is provided a resilient locking arm 54, and a locking claw 55 is formed on the locking arm. When the housing main body 61 is inserted into a housing main body 71 of a cooperating connector, connection terminals 67 and 72 are coupled with each other. The locking claw 55 provided on the locking arm 54 of the rear holder 51 is engaged with a locking portion 73 of the housing main body 71 of the cooperating second connector.

8 Claims, 10 Drawing Sheets

ELECTRICAL CONNECTOR HAVING LOCKING MECHANISM FOR LOCKING CONNECTOR HOUSINGS

TECHNICAL FIELD

The present invention relates to an electrical connector including a pair of connectors each having connection terminals installed therein, said connectors being detachably coupled with each other to establish the electrical connection.

TECHNICAL BACKGROUND

In generally known electrical connectors, connection terminals are installed in a housing main body such that the connection terminals are held in position by means of clamping lances formed integrally with the housing main body to prevent the connector terminals from being drawn backwardly. In order to improve the locking, there has been proposed to couple a rear holder to a rear portion of the housing main body and to lock the connector terminals by clamping lances formed integrally with the rear holder.

After coupling mutually cooperating connectors with each other, these connectors are locked by means of locking mechanisms provided on the housing main bodies of the connectors. In general, the rear holder does not have any role for mutually locking the connectors, and therefore the locking of the rear hold could not be performed sufficiently. Upon coupling the mutually cooperating connectors with each other, if a relatively large force is applied to the rear holder, the rear holder might be removed from the housing main body.

Furthermore, since a locking arm for locking the housing main bodies of the mutually cooperating connectors with each other is provided on one of the housing main bodies, this housing main body is liable to be large in size and a height of the housing main body is increased.

The present invention has for its object to provide an electrical connector, in which the above mentioned problems can be effectively removed and upon coupling first and second connectors with each other, a rear holder of the first connector can be positively locked to a housing main body of the first connector by locking the rear holder to a housing main body of the second connector.

DISCLOSURE OF THE INVENTION

According to the invention, an electrical connector comprising first and second connectors each including connector terminals which are coupled with each other by coupling the first and second connectors with each other, characterized in that a rear holder for preventing the connector terminals installed in the first connector from being withdrawn backwardly is engaged with a rear portion of a housing main body of the first connector, and that said rear holder includes a locking mechanism for locking the rear holder with the second connector.

BEST MODE OF THE INVENTION

Figure 1:
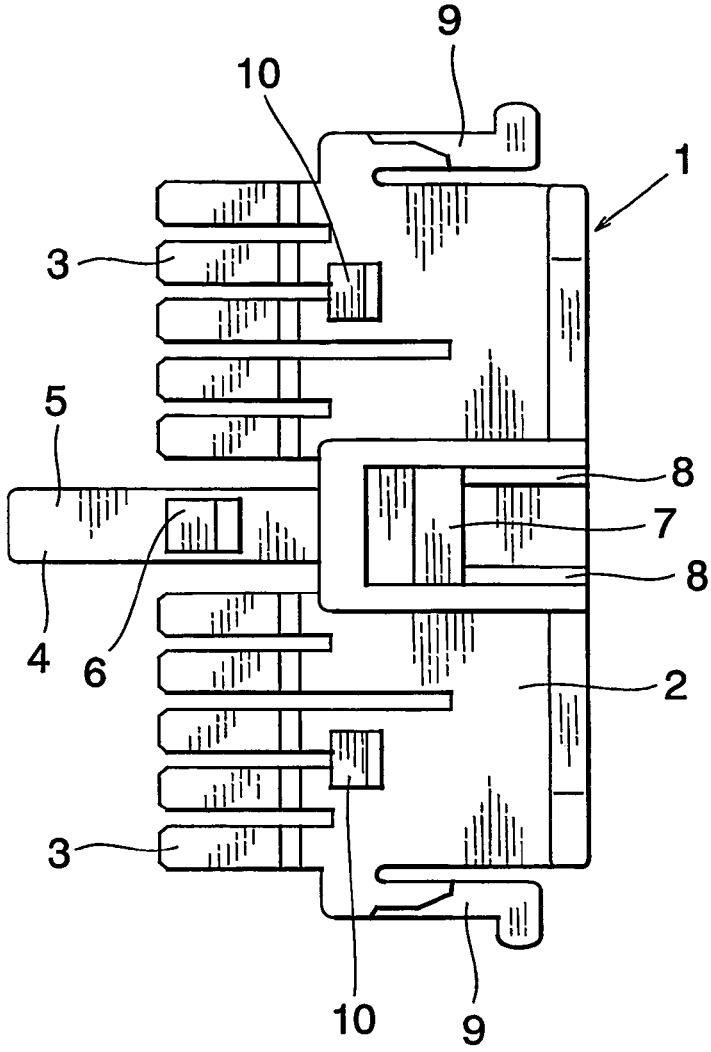
FIG. 1 is a plan view showing a rear holder of a first embodiment of the electrical connector according to the invention.

Now the present invention will be explained in detail with reference to the embodiments shown in the drawings.

Figure 2:
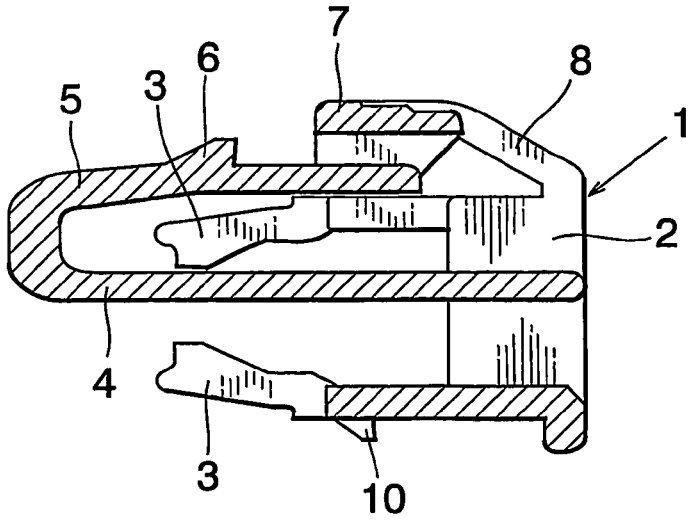
FIG. 2 is a cross sectional view of the rear holder.

FIGS. 1 and 2 are a plan view and a cross sectional view, respectively showing a rear holder 1 of a first embodiment of the electrical connector according to the present invention. The rear holder 1 comprises a rear holder main body 2 including a plurality of resilient clamping lances 3 which protrude forwardly such that each clamping lances are inserted into respective one of a plurality of terminal receiving holes formed in a housing main body to clamp respective connection terminals. At a middle upper portion of the rear holder main body 2. there is provided a resilient locking arm 4 which is formed in U-shape having a folded portion situating forwardly. An upper arm 5 of the locking arm 4 extends backwardly and has a locking claw formed thereon. At a front end of the upper arm 5 there is provided a lock releasing portion 7 which is connected to the rear holder main body 2 by means of a resilient arm 8. A reference numeral 9 denotes a completely engaging claw and a reference numeral 10 shows a preliminarily engaging claw.

Figure 3:
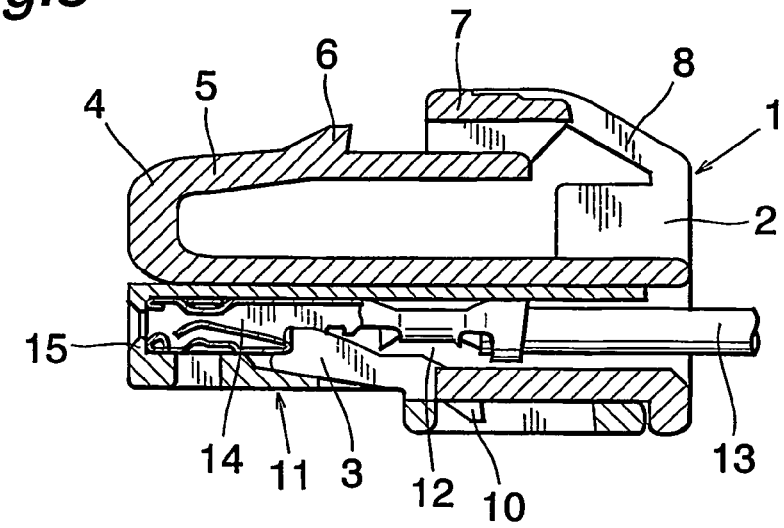
FIG. 3 is a cross sectional view of the rear holder.

FIG. 3 is a cross sectional view showing a first connector, in which the rear holder 1 has been inserted into a housing main body 11 from a backside and has been clamped therein. In the housing main body 11, there are formed two rows of terminal receiving holes 12, the upper row including eight holes and the lower row containing nine holes. A female connector terminal 14 having an electric wire 13 connected thereto is inserted into the terminal receiving hole 12 such that a front end of the connector terminal 14 is urged against a stopper portion 15, and therefore the connector terminal 14 could not be moved forwardly any more. When the rear holder 1 is inserted into the housing main body 11 from the backside, the locking lance 3 is inserted into the terminal receiving hole 12 such that the locking lance 3 is urged against a rear edge of a connecting portion of the connection terminal 14.

It should be noted that during the operation of inserting the rear holder 1 into the housing main body 11, a completely engaged condition with the completely engaging claw 9 as shown in FIG. 3 is attained via a preliminarily engaged condition with the preliminarily engaging claw 10. This will be explained later in detail with reference to a third embodiment.

Figure 4:
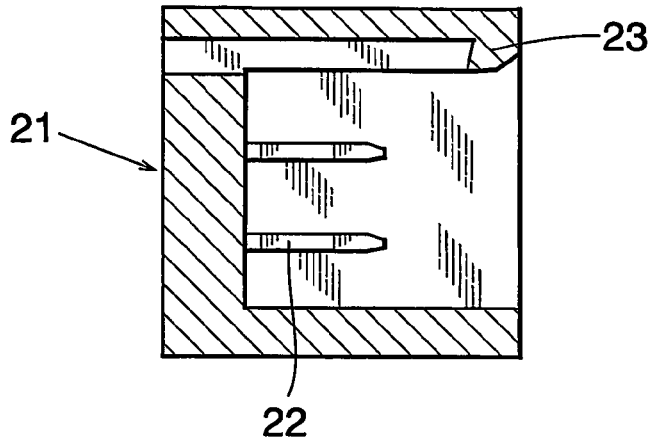
FIG. 4 is a cross sectional view illustrating a front end portion of a cooperating connector.
Figure 5:
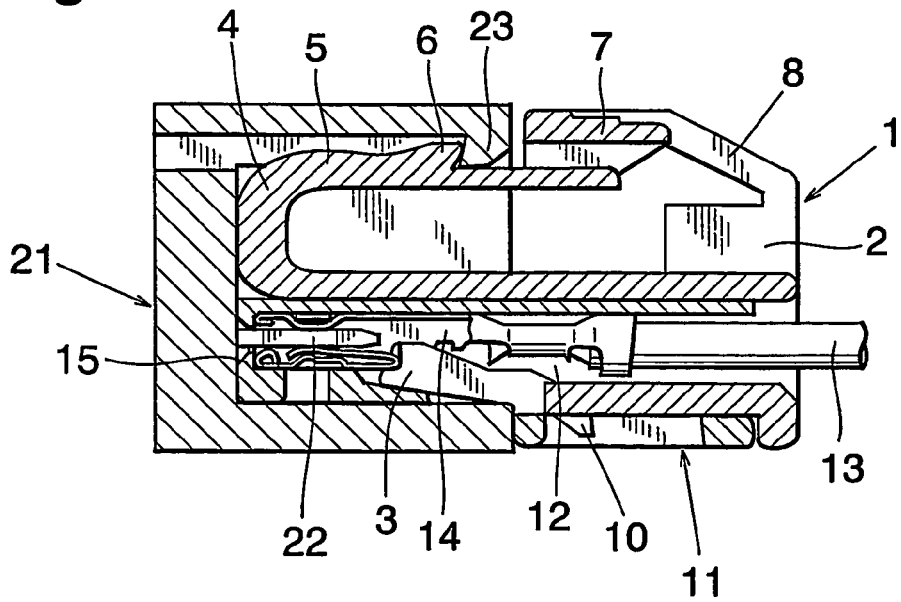
FIG. 5 is a cross sectional view depicting a coupled condition with the cooperating connector.

FIG. 4 is a cross sectional view showing a front end portion of a housing main body 21 of a cooperating connector which is to be coupled with the first connector, while a rear portion of the housing main body 21 is not shown in the drawing. The housing main body 21 has installed therein a plurality of male type connection terminals 22 each of which is to be connected to respective one of the female type connection terminals 14 installed in the housing main body 11 of the first connector. In the housing main body 21 there is provided a locking portion 23 which is to be engaged with the locking claw 6 of the rear holder 1. FIG. 5 is a cross sectional view illustrating a condition in which the first and second connectors are engaged with each other. The housing main body 11 is inserted into the cooperating housing main body 21 and the connection terminals 14 and 22 are engaged with each other to establish the electrical connection. During this engaging operation, the locking arm 4 of the rear holder 1 is resiliently bent downward to pass under the locking portion 23 of the housing main body 21, and then the locking arm 4 is returned into the original posture and a locking claw 6 at the locking arm 4 is engaged with the locking portion 23 to establish the locking. In this manner, the rear holder 1 and housing main body 21 of the second connector are locked, while the housing main body 11 of the first connector is clamped between the rear holder 1 and the housing main body 21.

Figure 6:
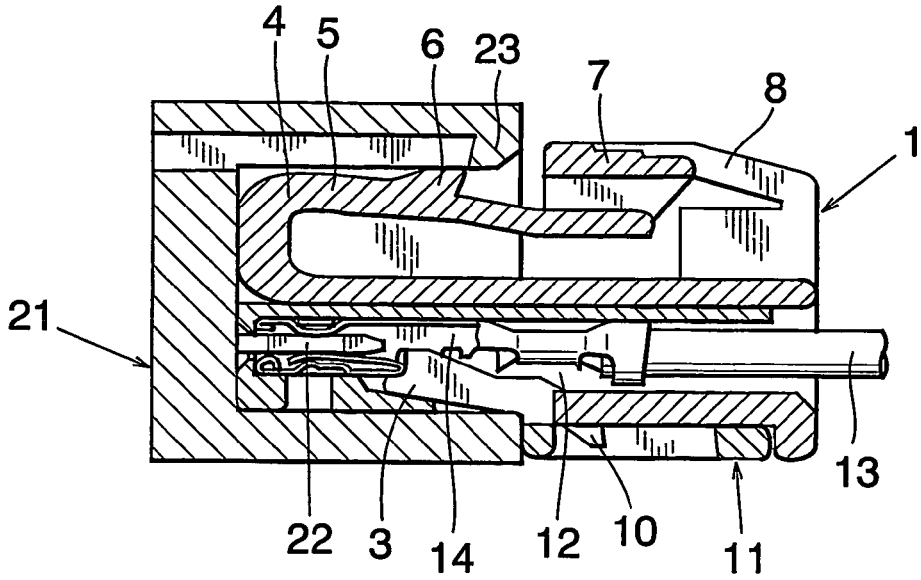
FIG. 6 is a cross sectional view showing a condition in which the engagement with the cooperating connector is released.

When it is required to release the locking condition, the lock releasing portion 7 provided at a free end of the locking arm 4 is pushed downward as illustrated in FIG. 6 by a finger to move the locking arm 4 downward and the locking claw 6 is removed from the locking portion 23. Then, the housing main body 11 may be drawn from the housing main body 21.

Figure 7:
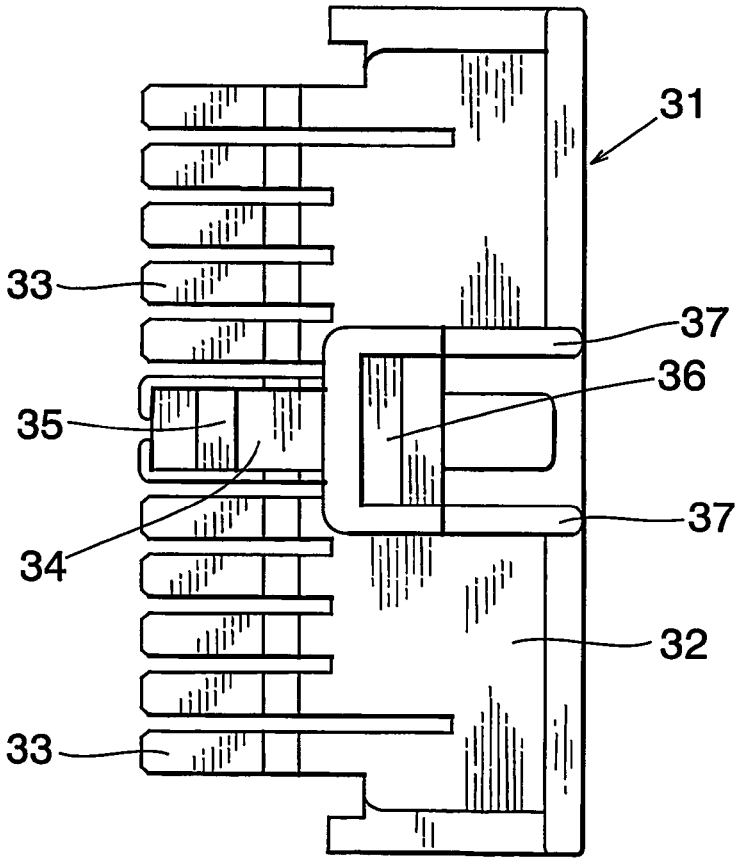
FIG. 7 is a plan view illustrating a rear holder of a second embodiment of the electrical connector according to the invention.
Figure 8:
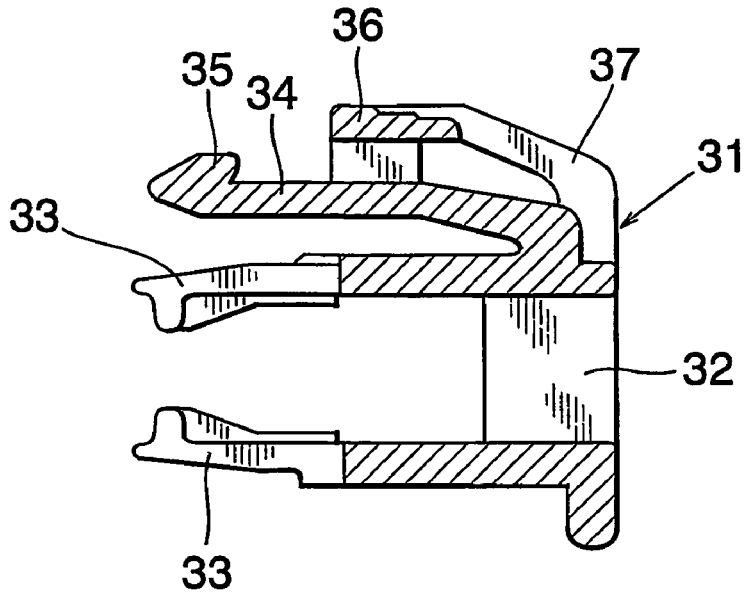
FIG. 8 is a cross sectional view of the rear holder.

FIGS. 7 and 8 are a plan view and a cross sectional view, respectively depicting a second embodiment of the rear holder 31. In the present embodiment, a rear holder main body 32 has formed therein clamping lances 33 and a locking arm 34 whose free end extends forwardly, and a locking claw 35 is formed at the free end of the locking arm 34. At a middle of the locking arm 34 there is provided a lock releasing portion 36 which is coupled with the rear holder main body 32 via a resilient arm 37.

Figure 9:
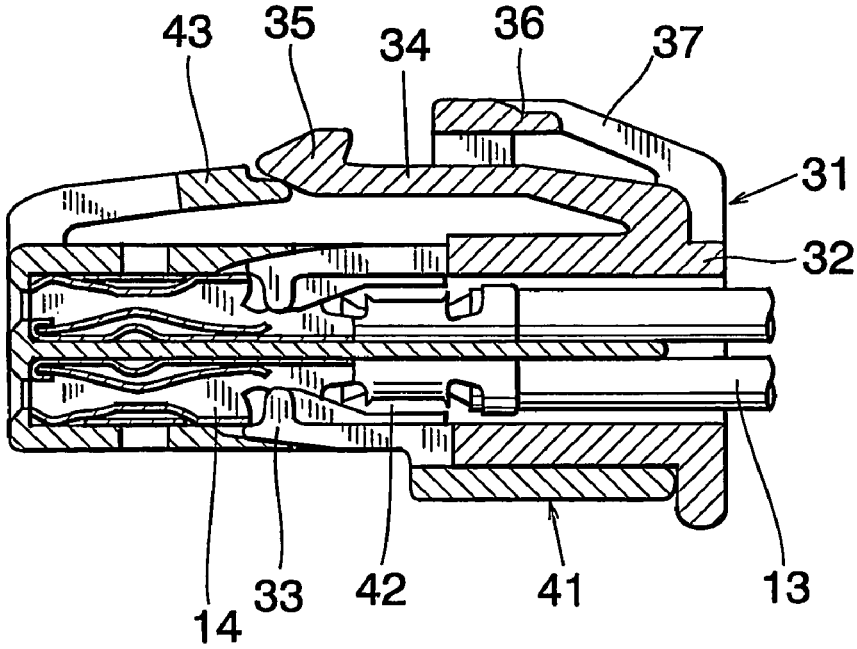
FIG. 9 is a cross sectional view of the connector.

FIG. 9 is a cross sectional view showing a condition in which connection terminals 14 are installed in a housing main body 41 and the rear holder 31 has been inserted into the housing main body 41. Connecting portions of the female type connection terminals 14 inserted into terminal receiving holes 42 are clamped by the clamping lances 33 of the rear holder 31. In the housing main body 41, there is provided a subsidiary arm 43 for reinforcing the resilient force of the locking arm 34 by pushing the locking arm 34 upwardly.

Also in the present embodiment, the complete or final engagement of the rear holder 31 is attained via the preliminary engagement, but preliminarily engaging claw and completely engaging claw provided on the rear holder 31 are not shown in the drawings.

Figure 10:
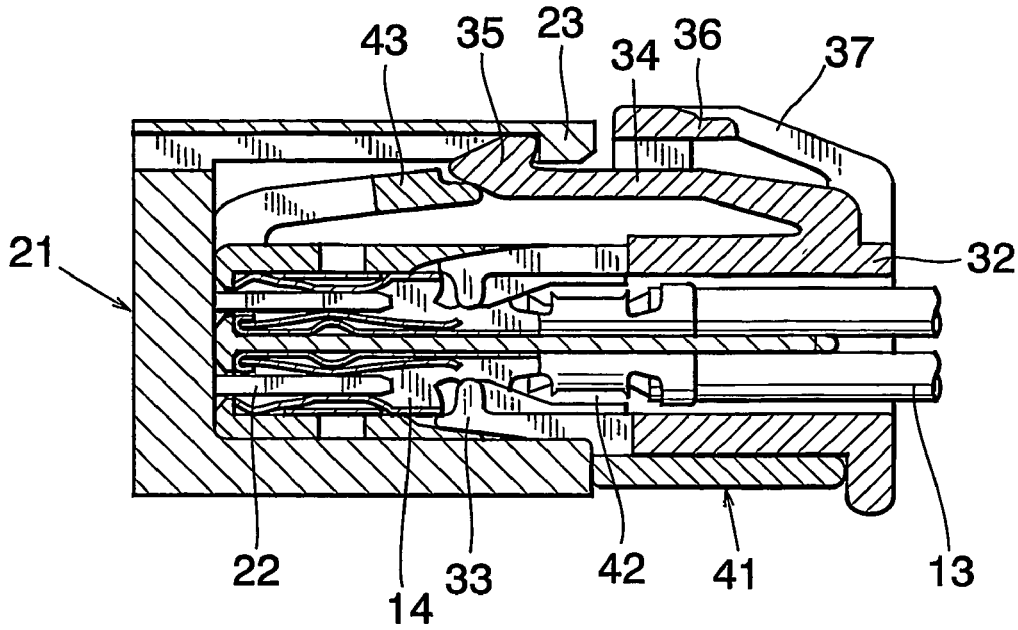
FIG. 10 is a cross sectional view depicting a coupled condition with a cooperating connector.

FIG. 10 is a longitudinal cross sectional view illustrating a condition in which the housing main body 41 of the first connector and the housing main body 21 of the second connector have been coupled with each other. The locking claw 35 of the locking arm 34 provided on the rear holder 31 have been engaged with the locking portion 23 of the housing main body 21 of the second connector, and the rear holder 31 and housing main body 21 are locked with each other.

Figure 11:
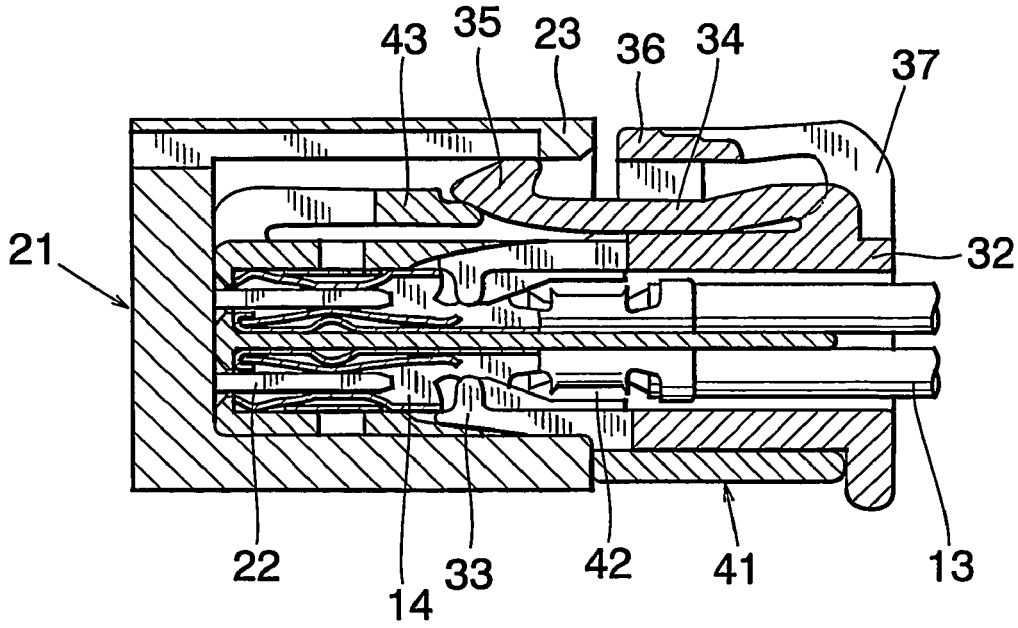
FIG. 11 is a cross sectional view showing a condition in which the engagement with the cooperating connector is released.

FIG. 11 depicts a condition in which the locking is released by pushing the lock releasing portion 36 downward to move the locking arm 34 downward against the force of the subsidiary arm 43.

Figure 12:
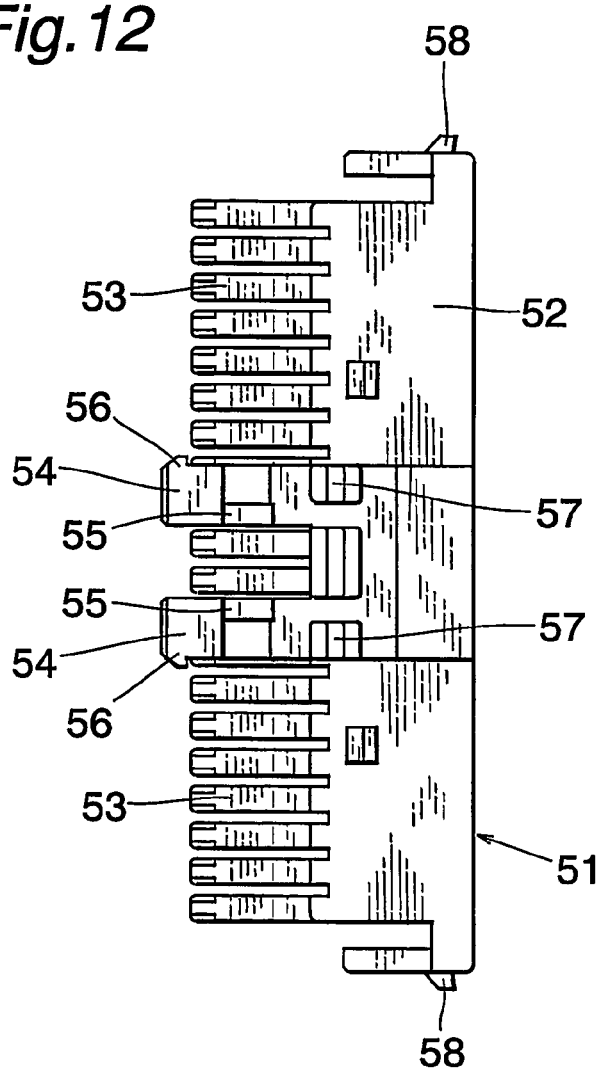
FIG. 12 is a plan view illustrating a rear holder of a third embodiment of the electrical connector according to the invention.
Figure 13:
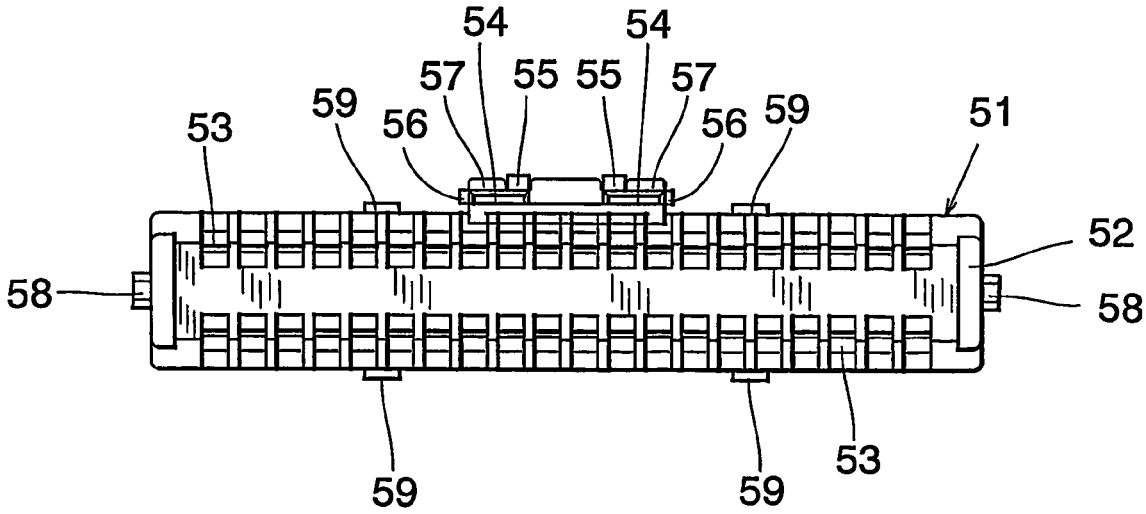
FIG. 13 is a front view of the rear holder.
Figure 14:
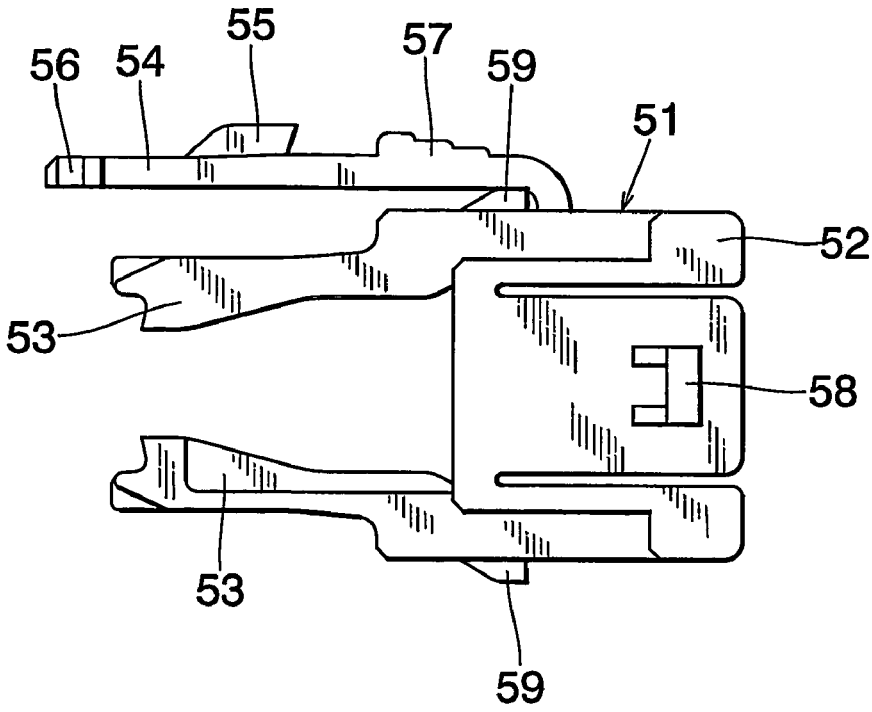
FIG. 14 is an enlarged side view of the rear holder.

FIGS. 12, 13 and 14 are a plan view, front view and an enlarged side view, respectively showing a rear holder 51 of a third embodiment of the electrical connector according to the invention. At a front end of a rear holder main body 52 of the rear holder 51 there are formed a plurality of clamping lances 53. At a middle upper portion of the rear holder main body 52 there are formed two resilient locking arms 54 which extend forwardly. Locking claws 55 are provided at front ends of these locking arms 54, interlocking portions 56 are provided on sides of these locking arms 54, and lock releasing portions 57 are provided on upper surfaces of root portions of these locking arms 54. On both sides of the rear holder main body 52 there are formed completely engaging claws 58, and on top and bottom surfaces of the rear holder main body 52 there are formed preliminarily engaging claws 59.

Figure 15:
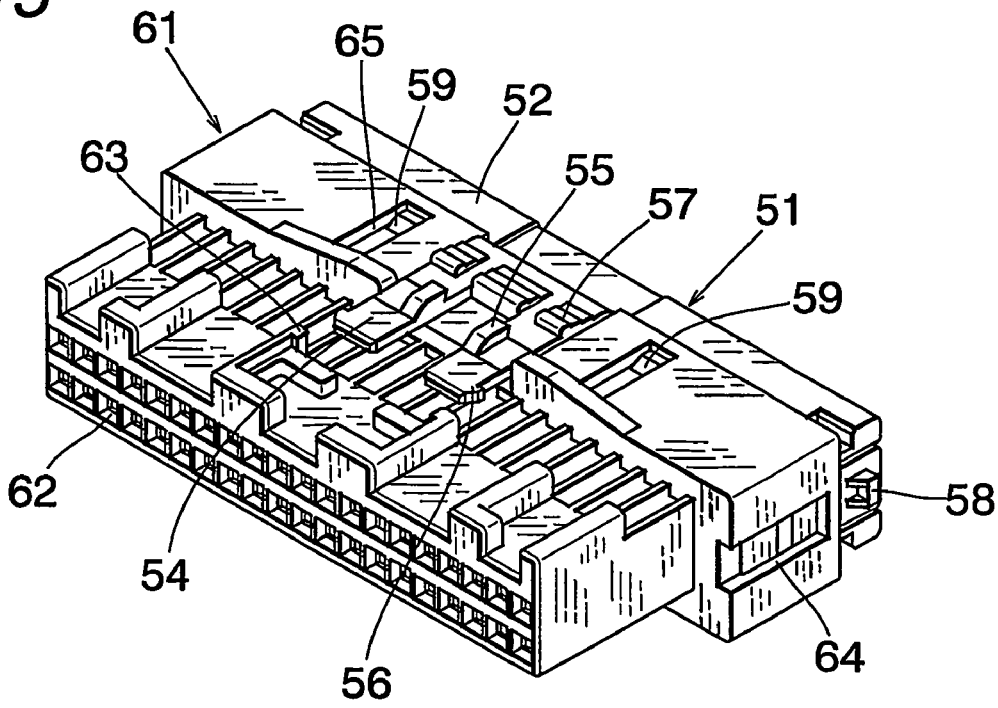
FIG. 15 is a perspective view showing a condition in which the rear holder is preliminarily engaged with a housing main body.
Figure 16:
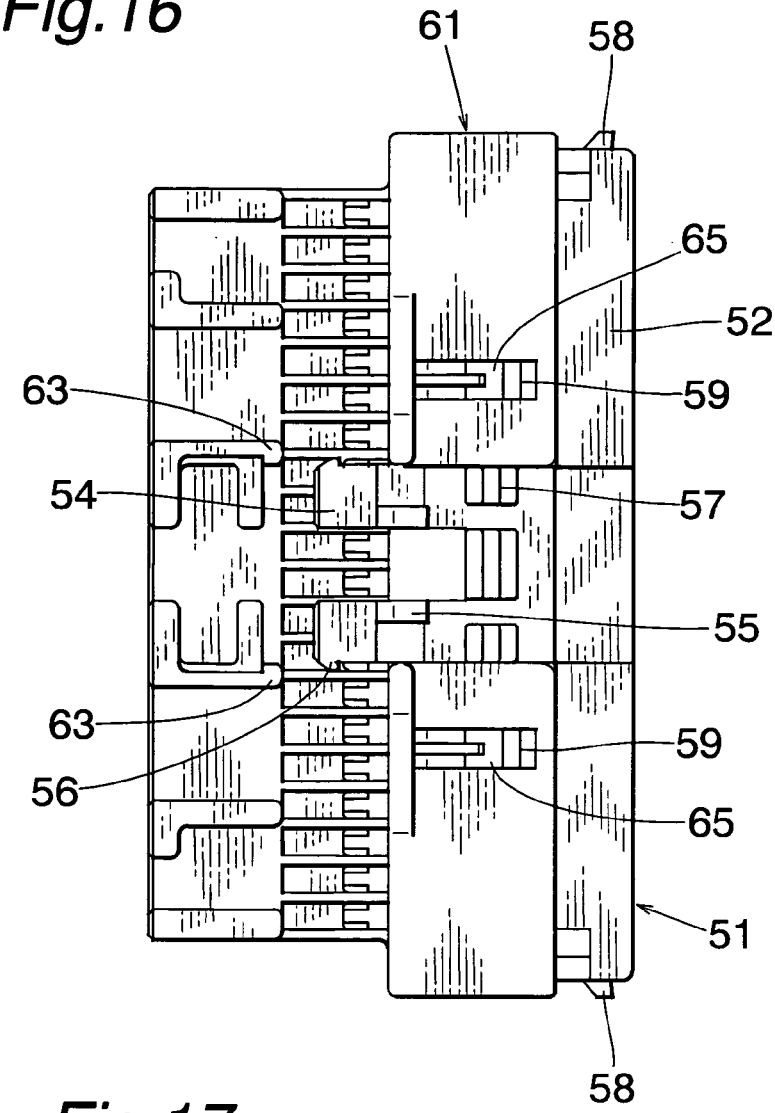
FIG. 16 is a plan view of the preliminarily engaged condition.
Figure 17:
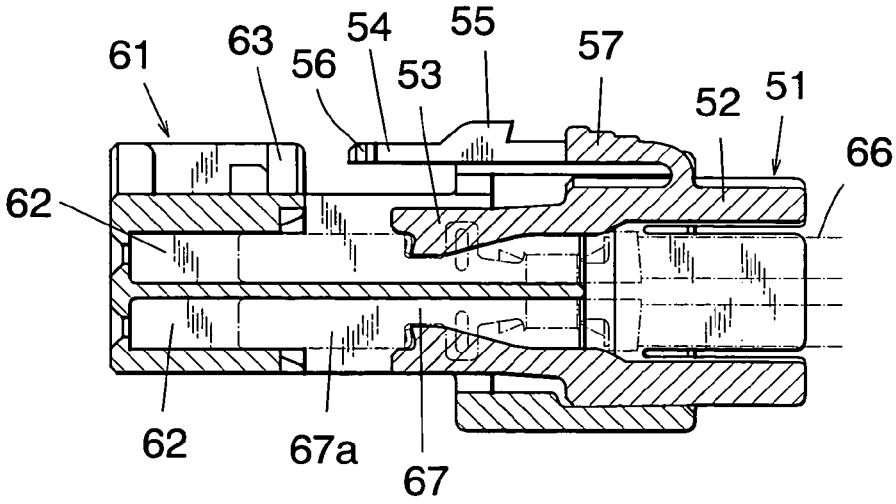
FIG. 17 is an enlarged cross sectional view of the preliminarily engaged condition.

FIGS. 15, 16 and 17 are a perspective view, plan view and an enlarged cross sectional view, respectively showing a condition in which the rear holder 51 has been inserted halfway into a housing main body 61 of a first connector into a preliminarily engaged position. Within the housing main body 61 there are formed two rows of terminal receiving holes 62 such that each of the upper and lower rows includes twenty holes. On an upper surface of the housing main body 61 there are formed interlocking portions 63 which are to be coupled with the interlocking portions 56 formed on the locking arms 54 of the rear holder 51, said interlocking portions serving to restrict an upward movement of the locking arms 54. On both sides of the housing main body 61 there are formed elongated recesses 64 which cooperate with the completely engaging claws 58 of the rear holder 51, and on the upper surface of the housing main body 61 there are formed elongated recesses 65 which cooperate with the preliminarily engaging claws 59 of the rear holder 51.

In the preliminarily engaged condition of the rear holder 51 with respect to the housing main body 61, since the preliminarily engaging claws 59 of the rear holder 51 are engaged with the elongated recesses 65 of the housing main body 61, the rear holder 51 is held stably, and the clamping lances 53 of the rear holder 51 are inserted into respective terminal receiving holes 62 formed in the housing main body 61. Now a female type connection terminal 67 having an electric wire 66 connected thereto is inserted from the backside via the rear holder 51 into the terminal receiving hole 62 as illustrated in FIG. 17. During this operation, a connecting portion 67*a* provided at a front end portion of the connection terminal 67 and including movable contact strips pushes the clamping lance 53 upward.

Figure 18:
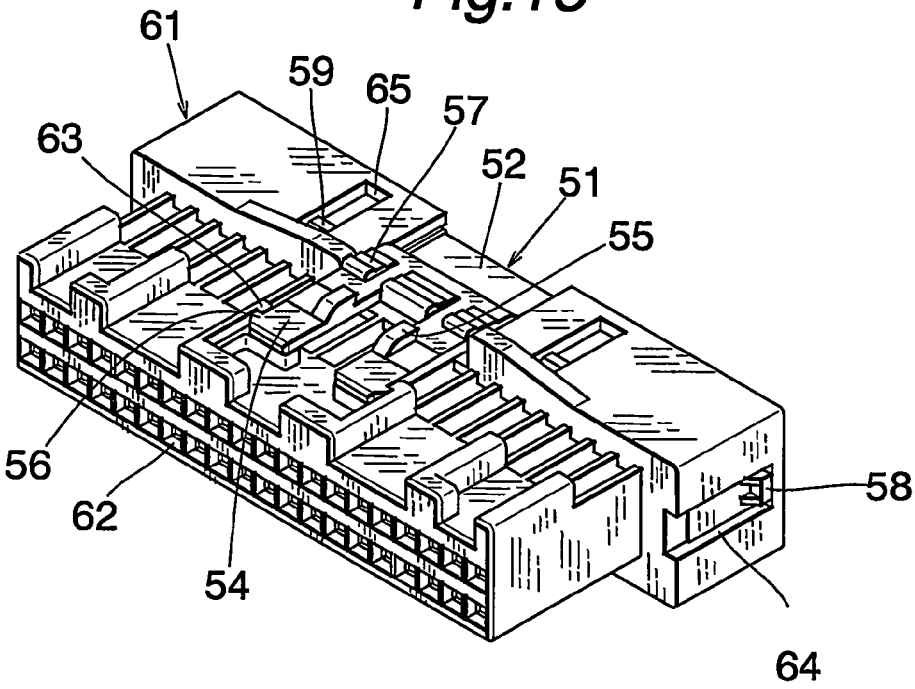
FIG. 18 is a perspective view illustrating a condition in which the rear holder is completely engaged with the housing main body.
Figure 19:
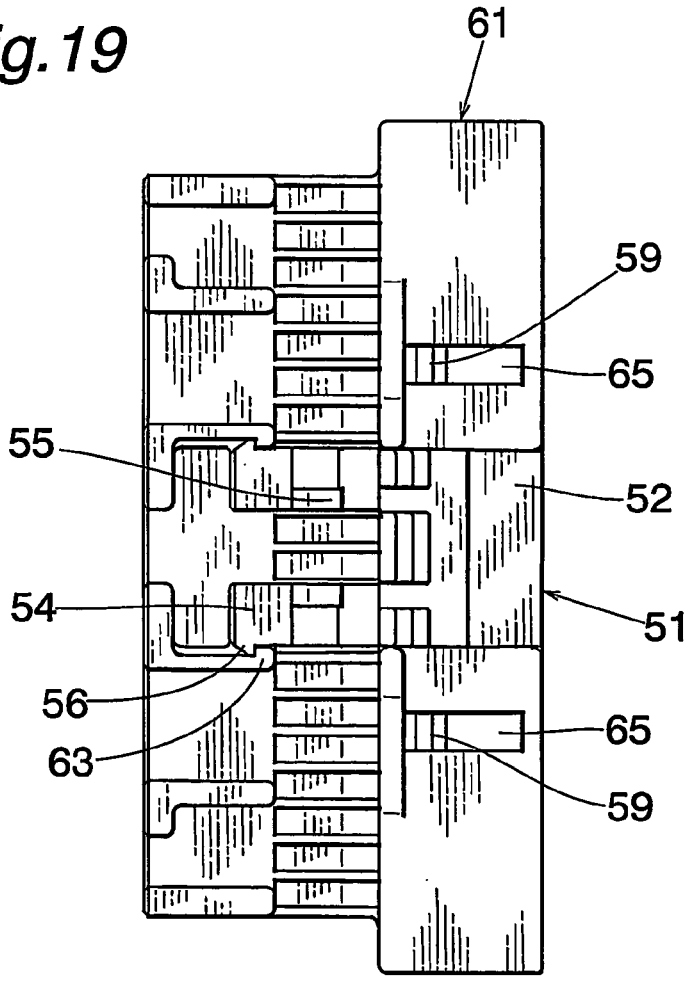
FIG. 19 is a plan view of the completely engaged condition.
Figure 20:
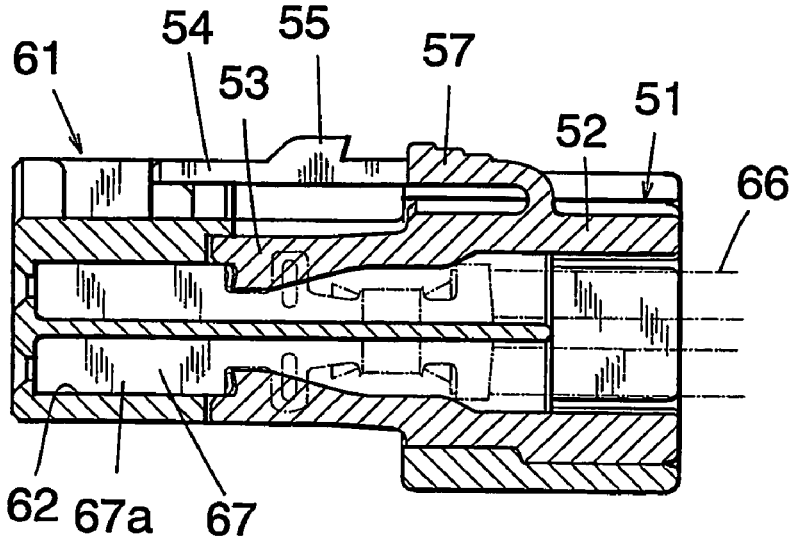
FIG. 20 is an enlarged cross sectional view of the completely engaged condition.

FIGS. 18, 19 and 20 are a perspective view, a plan view and an enlarged cross sectional view, respectively showing a completely engaged condition. After inserting all the connection terminals 67 have been inserted into the terminal receiving holes 62 in the preliminarily engaged position, the rear holder 51 is further pushed forwardly into the housing main body 61 into the completely engaged position. During this operation, rear edges of the connecting portions 67*a* are pushed by the clamping lances 53 and are inserted into front ends of the terminal receiving holes 62. Since the connection terminals 67 are urged against the inner walls of the terminal receiving holes 62, the connection terminals could not be drawn forwardly. Furthermore, the interlocking portions 56 of the locking arms 54 are engaged with the interlocking portions 63 formed on the housing main body 61, and therefore undesired upward movement of the locking arms 54 can be prevented.

Figure 21:
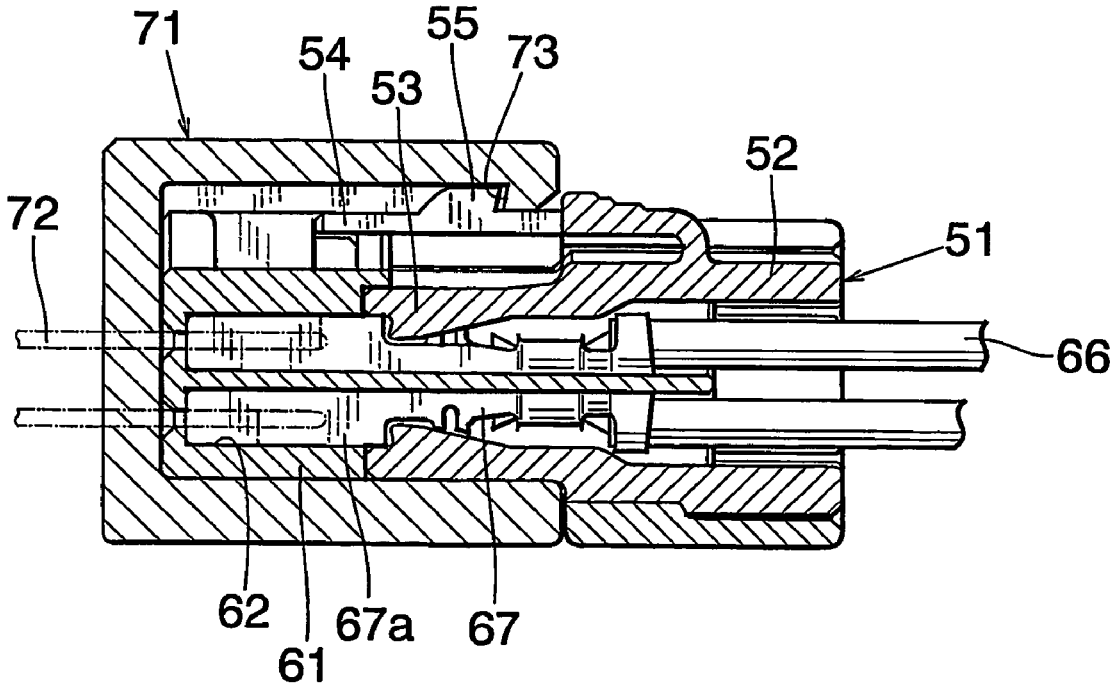
FIG. 21 is a cross sectional view showing a locking condition with a cooperating connector.

FIG. 21 is a cross sectional view illustrating a condition, in which the housing main body 61 of the first connector has been engaged with a housing main body 71 of a cooperating second connector. The housing main body 71 has installed therein a plurality of male type connection terminals 72 each of which is connected to respective one of the female type connection terminals 67 installed in the housing main body 61 of the first connector. In the housing main body 71 there are formed locking portions 73 which are engaged with the locking claws 55 of the locking arms 54 of the rear holder 51.

The housing main body 61 of the first connector has been inserted into the housing main body 71 of the cooperating second connector and the connection terminals 67 and 72 have been engaged with each other to establish the electrical connection. During this engaging operation, the locking arms 54 of the rear holder 51 is resiliently bent downward to pass under the locking portions 73 of the housing main body 71, and then the locking arm 54 is returned into the original posture and locking claws 55 at the locking arms 54 are engaged with the locking portions 73 to establish the locking. In this manner, the rear holder 51 and housing main body 71 of the second connector are locked with each other effectively.

When it is required to release the locking, the lock releasing portion 57 provided on the locking arms 54 are pushed downward by fingers to move the locking arms 54 downward and the locking claws 55 are removed from the locking portions 73. Then, the housing main body 61 of the first connector may be drawn from the housing main body 71 of the second connector.

In the above mentioned embodiments, the rear holder 1, 31, 51 provided in the housing main body 11, 41, 61 of the first connector is locked with the housing main body 21, 71 of the second cooperating connector, but according to the invention, the rear holder may be locked with a rear holder provided at a rear portion of the housing main body of the cooperating second connector.

APPLICABILITY IN THE INDUSTRIAL FIELD

As explained above, in the electrical connector according to the invention, since the rear holder provided in the rear portion of the housing main body of the first connector is locked with the cooperating second connector, as long as the locking mechanism is released, the two housing main bodies could not be separated from each other and the rear holder could not be removed from the housing main body of the first connector.

Furthermore, a height of the housing can be reduced as compared with a case in which the locking mechanism is provided on the housing main bodies. Since the housing main body of the first connector is clamped between the rear holder and the housing main body of the second connector, undesired play of the connection terminal installed within the housing main body of the first connector can be reduced.

Moreover, since the rear holder could not be coupled with the second connector as long as the rear holder has not been completely inserted into the housing main body of the first connector, a user can know an incomplete insertion of the rear holder into the housing main bod of the first connector.

What is claimed is:

1. An electrical connector comprising first and second connectors each including connector terminals which are coupled with each other by coupling the first and second connectors with each other, characterized in that a rear holder comprises a plurality of resilient clamping lances pushing respective ones of the connector terminals into a plurality of terminal receiving holes provided in the first connector in a single or multi-deck configuration and engaging the connector terminals therein not to be withdrawn backwardly, and a resilient locking arm including a free end extending forwardly and a locking claw provided thereon for locking the rear holder with the second connector, and that said locking arm is locked with a housing main body of the second connector or is locked with the rear holder secured to a housing main body provided in the second connector.

2. The electrical connector according to claim 1, wherein said locking claw is provided near the free end of said locking arm.

3. The electrical connector according to claim 1, wherein said locking claw is provided at a middle portion of the locking arm.

4. The electrical connector according to claim 1, wherein said free end of the locking arm is supported by a part of the housing main body of the first connector.

5. The electrical connector according to claim 4, wherein a lower portion of the free end of the locking arm is supported.

6. The electrical connector according to claim 4, wherein a side of the free end of the locking arm is supported.

7. The electrical connector according to claim 6, wherein an engaging portion which is engaged with a part of the housing main body of the first connector is provided on the side of the locking arm.

8. The electrical connector according to claim 1, wherein a plurality of said locking arms are provided.

* * * * *